United States Patent [19]

Nishioka et al.

[11] Patent Number: 4,974,019

[45] Date of Patent: Nov. 27, 1990

[54] IMAGE FORMING DEVICE OPERABLE TO START RECORDING BY SETTING RECORDING MATERIALS

[75] Inventors: Nobuaki Nishioka; Kiyoshi Emori, both of Toyokawa, Japan

[73] Assignee: Minolta Camera Kabushiki Kaisha, Osaka, Japan

[21] Appl. No.: 418,739

[22] Filed: Oct. 3, 1989

Related U.S. Application Data

[63] Continuation of Ser. No. 157,170, Feb. 11, 1988, abandoned, which is a continuation of Ser. No. 854,747, Apr. 22, 1986, abandoned.

[30] Foreign Application Priority Data

Apr. 26, 1985 [JP] Japan ..... 60-91787

[51] Int. Cl.[5] ..... B65H 3/44

[52] U.S. Cl. ..... 355/206; 271/9; 271/265; 355/311

[58] Field of Search ..... 355/206, 311

[56] References Cited

U.S. PATENT DOCUMENTS

| | | | |
|---|---|---|---|
| 3,977,666 | 8/1976 | Suzuki et al. | 271/164 X |
| 4,054,380 | 10/1977 | Donohue et al. | 355/14 |
| 4,265,440 | 5/1981 | Sibazaki et al. | 271/259 X |
| 4,310.153 | 1/1982 | Kikuchi | 271/259 |
| 4,386,769 | 6/1983 | Ito et al. . | |
| 4,466,604 | 8/1984 | Kishimoto et al. | 271/111 |
| 4,530,494 | 7/1985 | Saitoh et al. | 271/164 X |
| 4,620,782 | 11/1986 | Kurando et al. | 271/259 X |
| 4,734,739 | 3/1988 | Inuzuka et al. | 355/145 H |

*Primary Examiner*—Andres Kashnikow
*Assistant Examiner*—Gregory L. Huson
*Attorney, Agent, or Firm*—Wenderoth, Lind & Ponack

[57] ABSTRACT

An image forming device having a paper feeding function for automatically feeding recording paper. The device is provided with a function in which a copying or printing operation is interrupted on a detection of exhaustion of the paper and in which the operation is resumed on a detection of presence of paper after paper replenishment. The device is also provided with another function in which the operation is resumed only when the replenished paper is detected to be of a size feasible for the interrupted operation.

22 Claims, 7 Drawing Sheets

IMAGE FORMING DEVICE OPERABLE TO START RECORDING BY SETTING RECORDING MATERIALS

This application is a continuation of now abandoned application, Ser. No. 07/157,170 filed on Feb. 11, 1988, which was a continuation of now abandoned application Ser. No. 06/854,747, filed Apr. 22, 1986.

BACKGROUND OF THE INVENTION

The present invention relates to a paper feeding device to feed paper to an image recording section of an image forming device in a copy machine or various types of printers and the like.

With a known image forming device comprising the paper feeding device, when a copying operation is interrupted for an exahustion of paper, an operator must reoperate a print control key to resume copying function after mounting a storage member replenished with newly loaded paper to the image forming device.

However, the operation of the print control key for resuming the copying function imposes troubles on the operator. Particularly, in the case of a printer or the like constituting an output terminal unit of a host computer, wherein the paper feeding device is included in the printer and a control panel comprising the print control key is included in the computer, an operator must move between distant places to resume the copying functioning.

Summary of the Invention

An object of the present invention is to alleviate the troublesome procedures for resuming the copying function after loading paper into a paper storage cassette.

One characterizing feature of a paper feeding device embodying this invention is copying resumption signal output means provided to send a signal for resuming copying function to an image forming device when presence of paper is confirmed by paper presence and absence detection means after an output of a copying interruption signal by copying interruption signal output means.

Based on the idea that an exhausted paper supply in the cassette should not necessarily be considered an error, an automatic copy resuming system is employed which eliminates the reoperation by an operator when paper is newly loaded.

As a result, the resumption of copy function interrupted for the exahustion of paper requires only to mount the cassette replenished with paper, thereby eliminating the extra troubles after the paper replenishment.

This is particularly advantageous in alleviating an operator's troubles in case of printers or the like constituting a terminal unit of a host computer, wherein the paper feeding device and the control panel are distantly disposed.

BRIEF DESCRIPTION OF DRAWINGS

The drawings illustrate embodiments of a paper feeding device according to the present invention, in which.

DESCRIPTION OF THE PREFERRED EMBODIMENTS

An embodiment of the present invention is described hereinafter with reference to the drawings.

Figure 1:
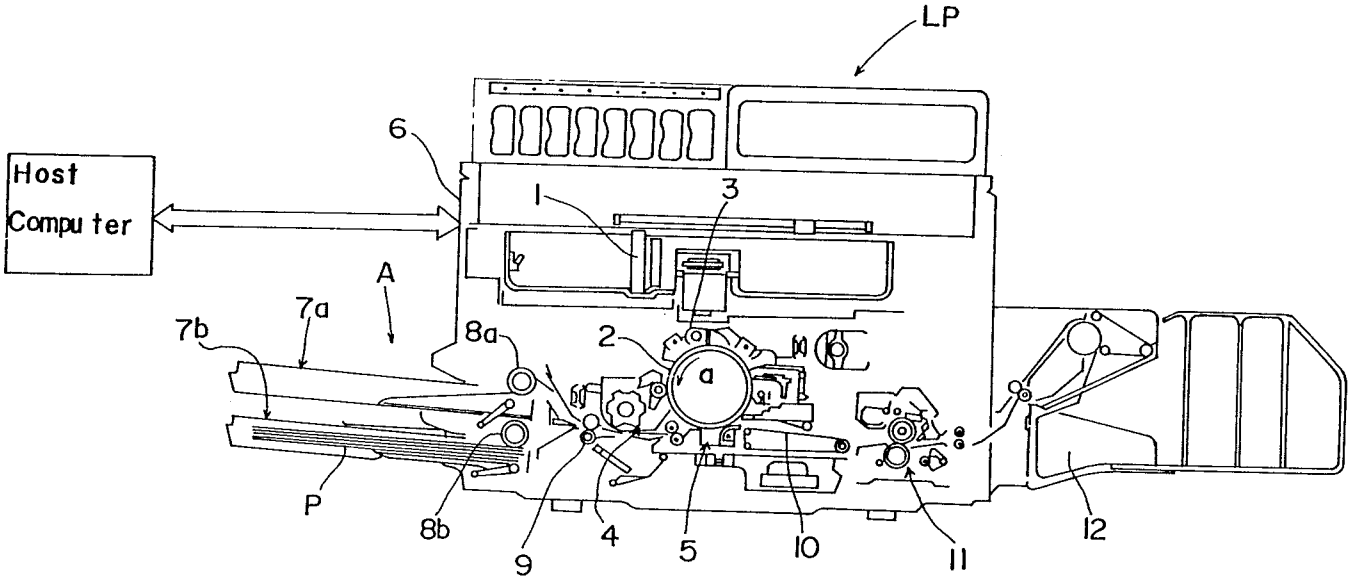
FIG. 1 is a section view of a laser beam printer.

FIG. 1 is a schematic section view of a laser beam printer LP as an example of an image forming device. The laser beam pritner LP constitutes a terminal unit of a host computer HC, and comprises a laser optical section 1 where laser beam is modulated according to an output from the host computer. The modulated laser beam is projected on a photosensitive drum 2 rotatable in the direction of 'a' as shown. The surface of the photosensitive drum 2 is uniformly electrified by means of a main charger 3, an electrostatic latent image being formed through the de-electrification of the laser-beamed portion. The electrostatic latent image becomes toner image by applying toner thereto in a develping member 4 with a rotation of the photosensitve drum 2, the toner being transferred to paper P in a transfer section 5.

Two paper feeding cassettes 7*a* and 7*b* as an example of a paper storage means attachable to and removable from the printer 6 accommodate different sizes of paper therein, respectively. Paper of a desired size is picked up from either of the cassettes 7*a* and 7*b* by means of pick-up rollers 8*a* and 8*b*, and is then delivered to the transfer section 5 by a first conveyor 9. Paper P which is transferred with the toner image at the transfer section 5 is further delivered to a fixing device 11 by a second conveyor 10, where the toner image is fixed on the surface thereof by fusion-pressing the toner, and then the paper is stacked in an outer stacker 12.

Figure 3:
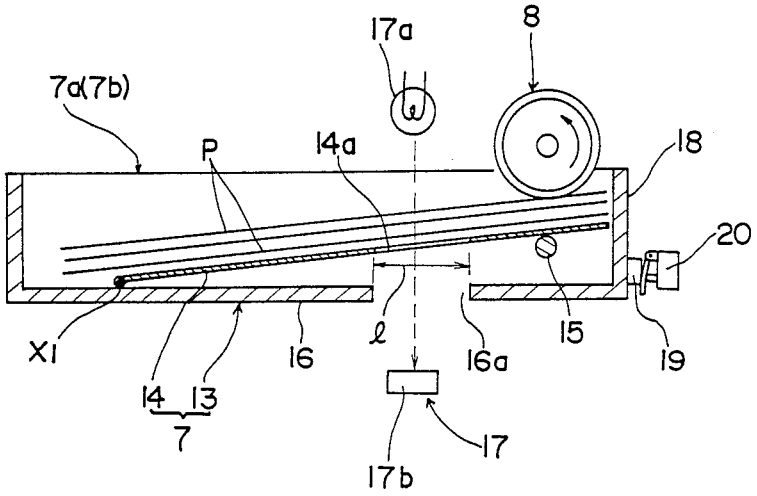
FIG. 3 is a schematic section view of the paper feeding device.

The paper feeding device is further described hereafter referring to FIG. 3. It is to be noted here that in the following description a paper feeding cassette 7 as representing the two paper feeding cassettes 7*a* and 7*b* is employed in order to simplify the description, as the constructions and functions of said two cassettes are substantially the same.

The paper feeding cassette 7 includes a vessel-like cassette frame 13 and a paper holding plate 14. The plate 14 is supported pivotably on an axis X1 in the cassette frame 13. When the cassette 7 is attached to the printer 6 as shown in FIG. 3, the plate 14 is lifted upwardly by a supporting roller 15 with the aid of a push-up spring member not shown to press the paper P on the plate 14 to the pick-up roller 8. A base plate 16 of the paper feeding cassette 7 and the paper holding plate 14 define openings 16*a* and 14*a*, while the printer 6 comprises a photosensor 17 consisting of a beam emitter 17*a* and a beam receiver 17*b* opposed to each other. A beam from the beam emitter 17*a* reaches the beam receiver 17*b* through the two openings 14*a* and 16*a* when the paper P becomes exhausted. That is, the exhaustion of the paper P in the paper feeding cassette 7 is detected when the beam receiver 17*b* receives the beam from the beam emitter 17*a*.

A side wall 18 of the paper feeding cassette 7, which constitutes a leading edge when the cassette is inserted into the printer 6, comprises a plurality of projections 19 arranged so as to correspond to the size of paper P stacked in the cassette 7, while the printer 6 is provided with four microswitches 20 disposed corresponding to the projections 19. When the cassette 7 including a size of paper P is mounted to the printer 6, the microswitches 20 corresponding to the size of paper are closed by contact with the projections 19. Thus, a size of paper P is detected through a closing pattern of the microswitches 20. The closing patterns further serve to indicate a mounting of the cassette 7. The closing patterns are also useful to indicate the other characters of the paper, for example color, thickness or the like.

Figure 2:
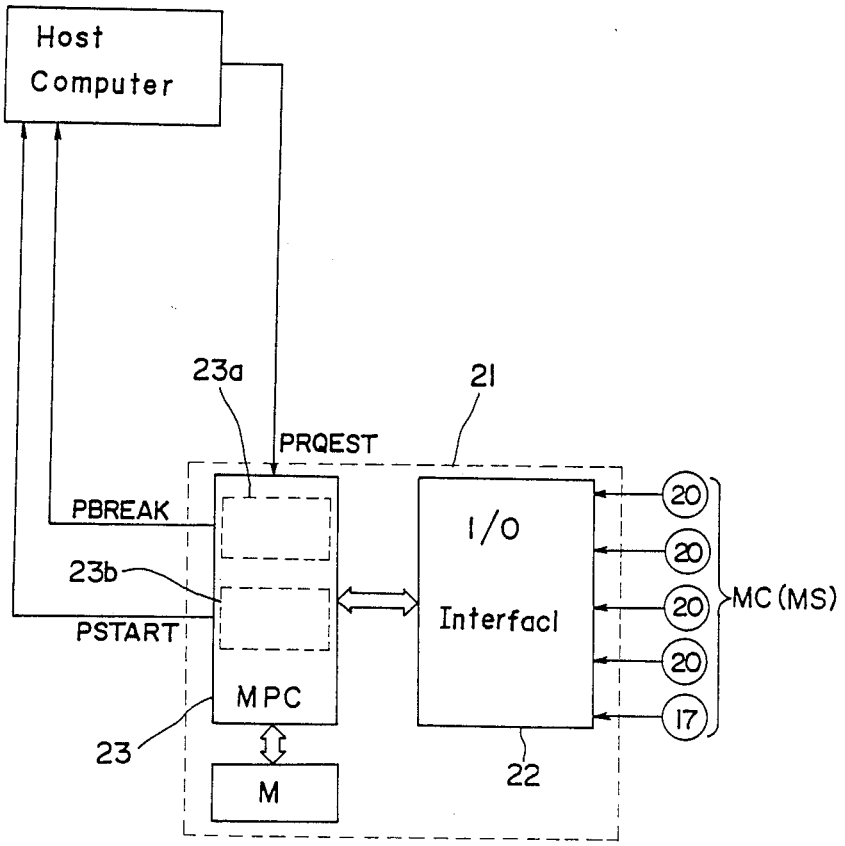
FIG. 2 is a block diagram of a control unit.

FIG. 2 shows a relationship between a control unit 21 to control operations of the printer 6 and the host computer which provides print commands and print data to the printer 6.

Figure 4:
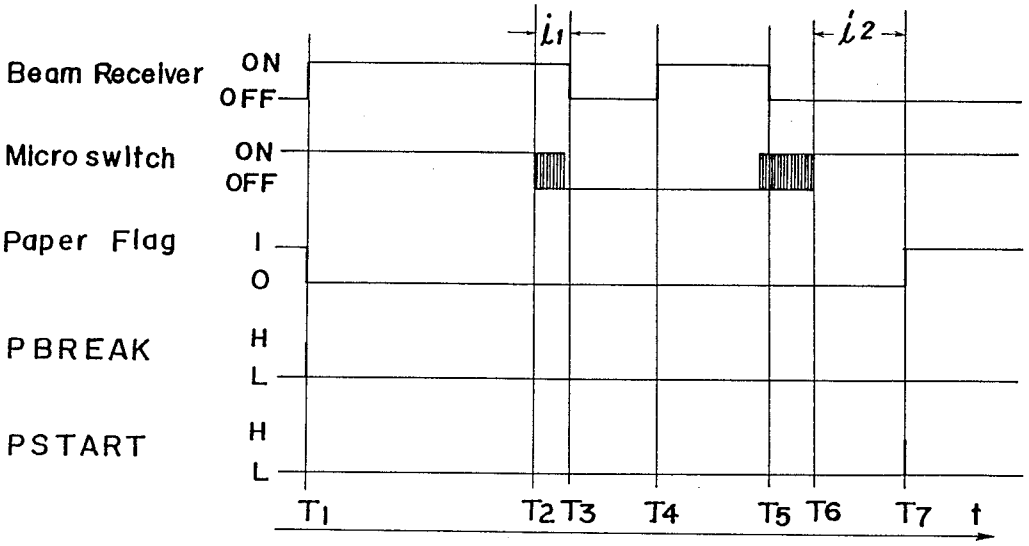
FIG. 4 is a timing chart showing a paper loading operation.

Outputs from the photosensor 17 and from said microswitches 20 are fed into an input and output interface 22 of the control unit 21 housed in the printer 6. The signals fed into the interface 22 are sent to a microprocessing unit 23 (an abbreviation 'MPU' is used hereafter). The MPU recieves a print request signal PRQEST provided by the operation of the print control key PC of the host computer HC. The MPU 23, based on statuses of the photosensor 17 and microswiches 20 and the print request signal PRQEST, sends print control signals, a print break signal PRBREAK and a print start signal PRSTART to the host computer HC. More particularly, a print break signal output means 23*a* and a print start signal output means 23*b* of the MPU 23 provide the signal PRBREAK and the signal PRSTART, respectively. A timing chart in FIG. 4 further describes the above-mentioned functions.

When the paper P in the cassette 7 is exhausted at a timing T1, the beam receiver 17*a* is turned 'ON' by receiving the beam from the beam emitter 17*a*, thereby setting a paper flag PF to '0', the signal PRBREAK being provided by the MPU 23 and then the copying is interrupted. At the same time the control panel of the host computer HC, though not shown, indicates the exahustion of the paper P. Subsequently, when an operator dismounts the cassette 7 in order to replenish the paper P therein, the microswiches 20 are turned 'OFF' at a timing T2. Then, after a time lapse i1, when the beam from the beam emitter 17*a* is interrupted by edges of the openings 14*a* and 16*a* formed in the cassette 7, the beam receiver 17*b* is turned 'OFF' at a timing T3. When the dismounting of the cassette 7 is completed, the beam receiver 17*b* is turned 'ON' by again receiving the beam from the beam emitter 17*a* at a timing T4, thereby determining the completion of the dismounting operation.

During the dismounting operation of the cassette 7, the microswitches 20 are often turned 'ON' and 'OFF' repeatedly in an arbitrary manner because of unsmoothness of the operation per se, thereby confusing a detection function for a normal dismounting operation. Therefore, the openings 14*a* and 16*a* formed in the cassette 7 are provided with a length '1' in the direction of mounting and dismounting so that the beam receiver 17*b* is turned 'OFF' only after the time lapse i1 until the unsmoothness is suppressed.

Then, when the operator loads the paper P in the cassette 7 and mounts the cassette 7 to the printer 6, the beam from the beam emitter 17*a* is interrupted by the cassette 13 and the paper P, and the beam reciever 17*b* is turned 'OFF' at a timing T5. On completion of the mounting of the cassette 7, as descibed above, one or more microswitches 20 are turned 'ON' based on the patterns corresponding to the paper size at a timing T6, thereby detecting for the normal mounting of the cassette 7 and for the size of the paper as well. If the detected size of the newly loaded paper coincides with the size of the initially loaded paper, the paper flag PF is set to '1' after a time lapse i2, which will be more particularly described later, at a timing T7 and the MPU 23 provides the print start signal PRSTART to resume the copying function.

To summarize the aforementioned processes, the copying function is resumed only after the time lapse i2 which allows the unsmoothness of the cassette mounting motion, thereby reducing the frequency of troubles caused when the paper P is picked up from the cassette 7.

Figure 5:
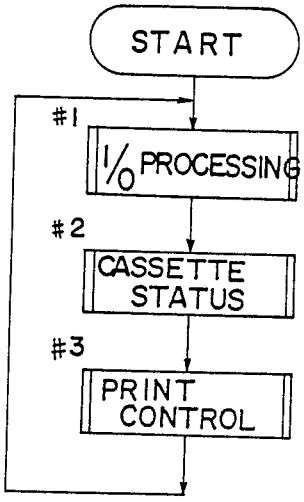
FIGS. 5, 6, and 7 are flow charts describing the functions of the laser beam printer.
Figure 6:
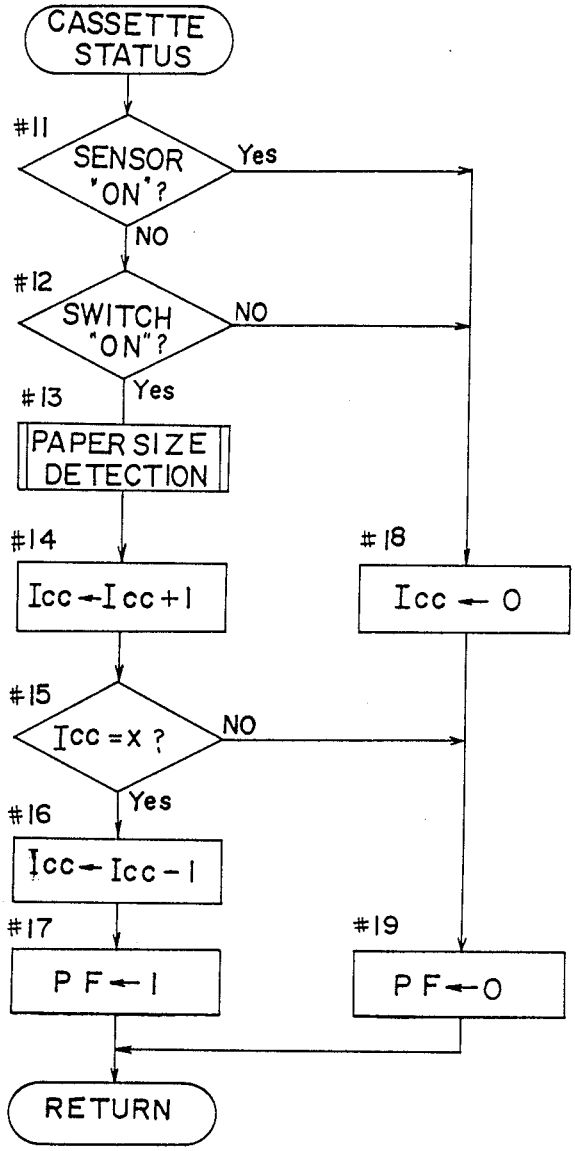
Figure 7:
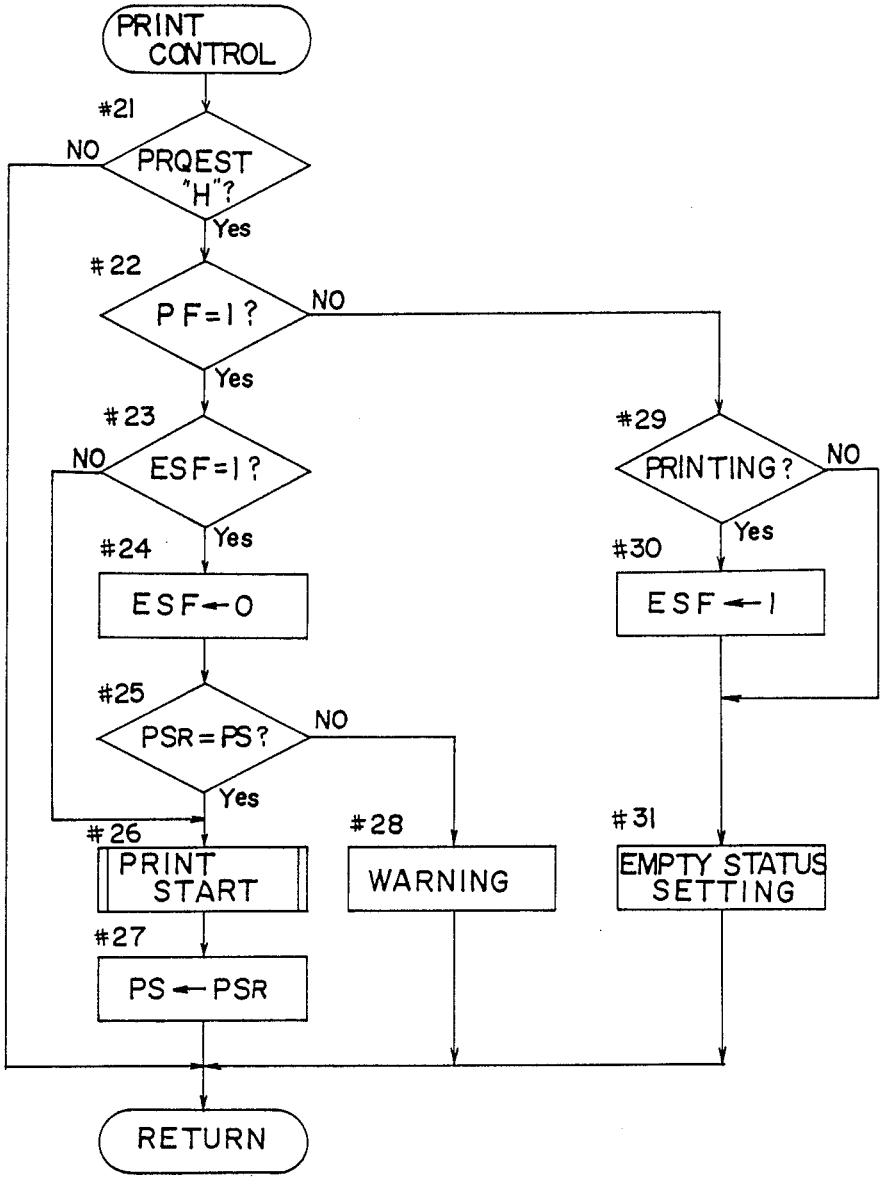

The following is a description of functions of the printer referring to flow charts in FIGS. 5 through 7. The flow chart in FIG. 5 describes an overall operation routine of the printer. At the first step #1 of the routine, input and output processing is carried out, wherein output signals from the photosensor 17 and from the microswitches 20 are read and errors are checked. At the second step #2, a cassette status is set. At the third step #3, a print control is executed, wherein respective flags required for a print operation are set and the print operation is started on a print request. The above-mentioned routine is repeated hereafter.

The flow chart in FIG. 6 describes a subroutine for setting a cassette status. At the first step #11 of the subroutine, a state of the beam receiver 17*b* included in the photosensor 17 is checked. If the beam receiver 17*b* is in the state of 'ON' thereby indicating exhaustion of the paper P in the cassette 7, a check counter ICC, which will be more particularly described later, and the paper flag PF are set to '0' at the steps #18 and #19 in succession in the mentioned order, an instruction being given to return to the main routine. If the beam receiver 17*b* is 'OFF', the state of microswitches 20 is checked at step #12. If the microswitches are 'OFF' thereby indicating that the cassette 7 is erroneously mounted or that the cassette 7 is still in the process of being mounted or dismounted, the counter ICC and the paper flag PF are set to '0' at the steps #18 and #19, an instruction being given to return to the main routine in the same manner as above.

If the microswitches are in the state of 'ON', instructions are given to detect a size of the paper P at the step #13, and then to increment the check counter ICC at the step #14, and to check the value of the check counter ICC at the step #15. If the value is below a predetermined number 'X', the paper flag PF is set to '0' at the step #19, and the subroutine returns to the main routine. Then, if the conditions at the steps #11 and #12 are satisfied when the subroutine is again called, the check counter ICC is incremented at the step #14. When the value of the counter ICC eventually reaches 'X', the subroutine proceeds to the step #16, decrementing the counter ICC, sets the paper flag PF to '1' at the step #17, and then returns to the main routine. The reason for the decrement operation of the counter ICC at the step #16 is as follows. The counter ICC is incremented if the conditions at the steps #11 and #12 are satisfied every time the subroutine is called. Therefore, as long as the conditions at the steps #11 and #12 are maintained the counter ICC is decremented at the step #16 between #15 and #17 in order to satisfy the condition at the step #15 and thereby to keep the paper flag to '1'.

The flow chart in FIG. 7 describes a subroutine for the print control. The subroutine, at the first step #21, checks the state of the print request signal PRQEST, which is set to 'H' level by an operation of the print control key PC included in the operation panel of the host computer HC and to 'L' level after printing a designated copy volume. If the signal is in 'L' level , that is , if there is no print request, the subroutine returns to the main routine. If the signal PRQEST is in 'H' level, that is, printing is requested, the subroutine checks the state of the paper flag PF at the step #22. If the paper flag is set to '0', indicating absence of the paper P as above-described, the subroutine further judges at the step #29 whether the printer is in operation or not.

An affirmative answer here indicates that the printer is in the middle of a multiprint mode operation for providing sucessive printing. In this case, the subroutine sets an empty stop flag ESF to '1' at the step #30 thereby setting a paper empty status, interrupts the printing functioning at the step #31, and then returns to the main routine. If the printer is judged to be out of the printing operation, it means that a first sheet of paper has not been printed. In this case, the main routine is resumed only after the paper empty status is set at the step #31 to interrupt the printing operation.

The above empty stop flag ESF is successively judged '1' at the step #23 if the paper flag PF is judged to be '1' at the step #22. The empty stop flag set to '1' indicates, as described hereinbefore, that the printer is in the middle of the multiprint mode, wherein a normal printing operation is impossible for differences of image areas unless a size of newly loaded paper PSr coincides with the size PS of the paper P loaded before said interruption, the size PS being stored in a RAM which is an example of memory means M. Therefore, the subrouinte, after resetting the empty stop flag ESF at the step #24, compares the two sizes, PSr and PS.

When the sizes PSr and PS are judged to be different, an operator will be warned of said difference by means of an illumination of a lamp or the like at the step #28. When the sizes PSr and PS are judged to be the same, the subroutine starts a print funcitoning at the step #26, newly stores the size PSr of the newly loaded paper P at the step #27, and then returns to the main routine. On the other hand, if the step #23 judges the empty stop flag ESF to be '0', the print functioning is started without comparing the sizes PSr and Ps at the step #26. And the subroutine returns to the main routine after storing size PSr of the newly loaded paper P at the step #27.

In the abovementioned embodiment, the other characters of the paper detected by the microswitches 20 are also available to the restart conditions. For example, when the size, color and thickness of the newly loaded paper coinside with those of formerly used paper, the interrupted copying operation is allowed to restart.

Figure 8:
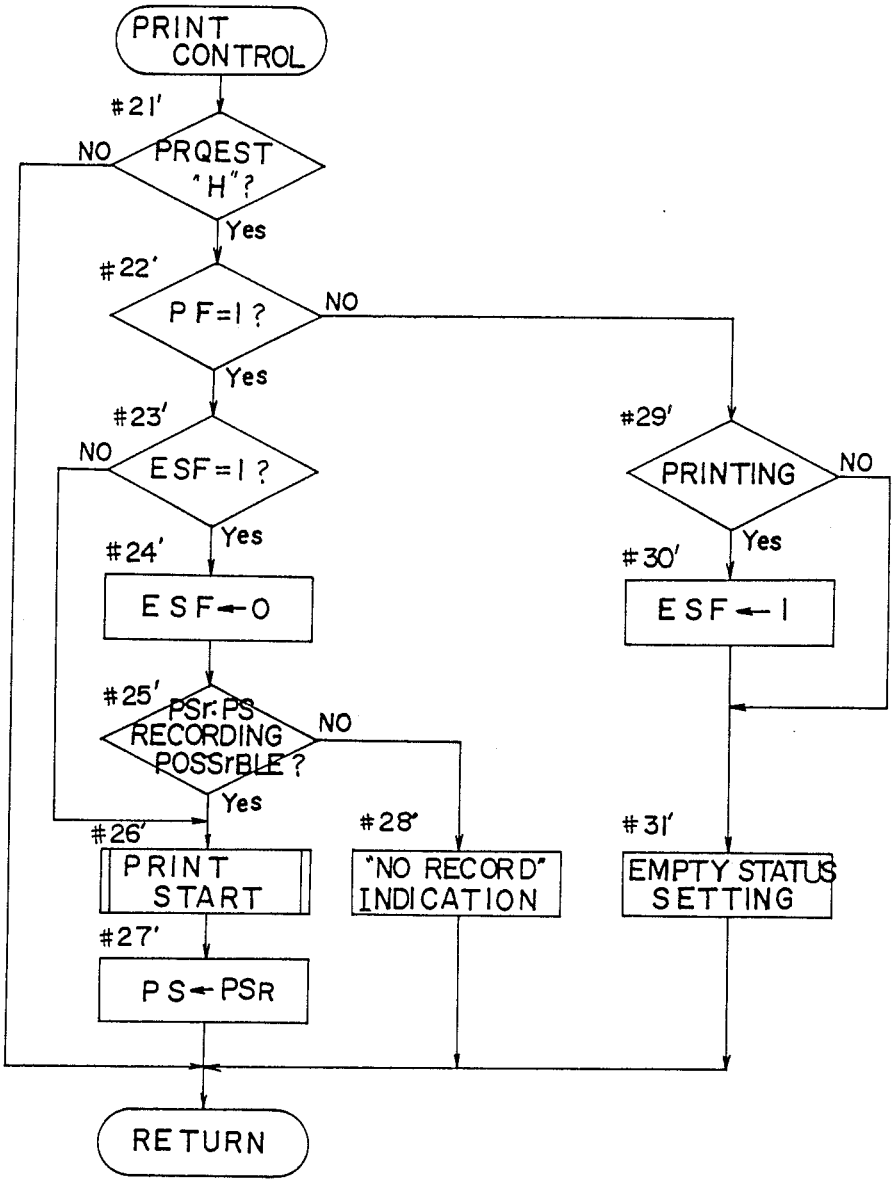
FIG. 8 is a modified flow chart corresponding to that of FIG. 7.

FIG. 8 describes another embodiment of the print control subroutine. In the foregoing embodiment, if the size PS of the paper loaded before the interruption and the size PSr of the newly loaded paper are different, the copying functioning is inhibited and the size difference warning is given at the step #26. However, there is a case in which a smooth succession of the copying operation before the interruption is possible by newly loaded paper of a different size. For instance, if an interruption is made when DIN size B5 paper was used, it is possible to resume the functioning with DIN size A 4 paper. The present embodiment being substantially the same as the aforementioned embodiment described in FIG. 7 except the steps #25' and #28', only the differences are described hereinafter.

At the step #25', a judgement is made by comparing the sizes, PS and PSr whether or not the resumption of the recording functioning is possible. Said judgement is executed, for example, according to Table 1. That is, when the sizes PS and PSr are the same or when the size PSr is larger than the size PS, the copying is started as the copying is possible without image losses. Said judgement may also be executed, for example, according to Table 2. As in the case of Table 1, the copying is started when the size PSr is larger than the size PS. However, if the size difference is extreme, the printing is inhibited to prevent image losses caused by the extreme difference between the image size and the paper size. If a judgement is made that the resumption of copying is impossible or undesirable at the step #25', the subroutine proceeds to the step #28', indicating the inhibition of printing. This indication may be provided either audibly or visibly or in both manners, or in other manners.

TABLE 1

| | | Size of Newly Loaded Paper PSr | | | | |
|---|---|---|---|---|---|---|
| | | A5 | B5 | A4 | B4 | A3 |
| Size of Initially Loaded Paper PS | A5 | O | O | O | O | O |
| | B5 | X | O | O | O | O |
| | A4 | X | X | O | O | O |
| | B4 | X | X | X | O | O |
| | A3 | X | X | X | X | O |

TABLE 2

| | | Size of Newly Loaded Paper PSr | | | | |
|---|---|---|---|---|---|---|
| | | A5 | B5 | A4 | B4 | A3 |
| Size of Initially Loaded Paper PS | A5 | O | O | X | X | X |
| | B5 | X | O | O | X | X |
| | A4 | X | X | O | O | X |
| | B4 | X | X | X | O | O |
| | A3 | X | X | X | X | O |

In the above tables, '0' denotes that printing is possible and 'X' denotes that printing is impossible or undesirable.

By utilizing the above-mentioned controls, the copying operation acquires flexibility since a copying operation using paper of a different but usable size is made possible when the supply of a certain size paper is exhausted.

If a single size paper is usable for the device, the judgement at the step #≅or at the step #25' concerning the difference of the paper size is not necessary.

Figure 9:
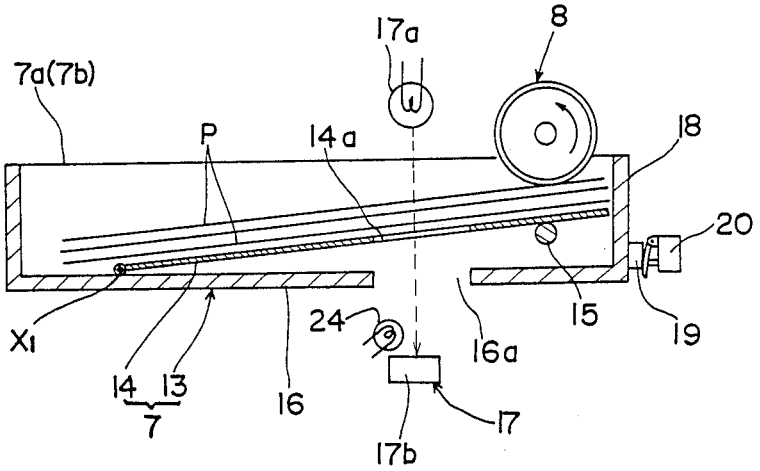
FIG. 9 is a section view of a modified paper feeding device.

FIG. 9 describes another embodiment of the means for detecting paper in the paper feeding cassette 7. An auxiliary lamp 24 is installed adjacent to the beam receiver 17*b* included in the printer 6. This auxiliary lamp is turned 'ON' when exahustion of the paper P is detected and is turned 'OFF' when the remounting of the cassette 7 is completed. In this embodiment, the beam receiver 17*b* maintains uninterruptedly the 'ON' state thereof by means of the illumination of the auxiliary lamp 24 even if the beam from the beam emitter 17*a* is interrupted by the cassette 13. Thus, the detection for a normal mounting of the cassette 7 may be performed by the openings 14*a* and 16*a* of a relatively small size without being adversely afffected by the unsmooth dismounting operation.

The four microswitches 20 in the above-mentioned embodiment are utilized both for detecting the mounting and dismounting of the cassette 7 and for detecting the paper sizes. However, said two detections may be made separately by using different means as described hereinafter. For the purpose of detecting the mounting and the dismounting the cassette 7, contact or noncontact switches may be installed. Said means are generically called herein detection means for mounting and dismounting of storage member MC. And, for the purpose of detecting the paper sizes, photosensors of a gap type, a reflex type or the links may be installed. Said means are generically called herein detection means for paper sizes MS.

Moreover, in place of the photosensor 17 consisting of the beam emitter 17*ak* and of the beam receiver 17*b*, which is described in the aforementioned embodiment, different means, which are generically called herein paper presence and absence detection means 17 may be installed, wherein a pair of contact points conductive only in the absence of paper in the cassette 7 are disposed opposed to each other across the paper so that the state of the conduction of the contact points may detect the presence and the absence of the paper.

The paper feeding device A embodying the present invention is applicable to various types of printers such as a laser beam printer LP as an image forming apparatus, a thermal printer, an ink jet printer, or the like, and to an image forming apparatus LP such as various types of copy machines as well.

What is claimed is:

1. A method for controlling an image forming apparatus, the apparatus including means for forming an image on recording materials; means for feeding said recording materials to said image forming means; means for detecting presence and absence of said recording materials in a designated position of said feeding means; and means for detecting a size of said recording materials, said method comprising the steps of:

inputting a command for starting operation of said image forming means;

inhibiting the starting of the operation of said image forming means if an absence of recording materials is detected in the designated position when the command is inputted;

uninhibiting the starting of the operation of the image forming means in response to detecting the presence of replenished recording materials in the designated position; and starting the operation of said image forming means following said uninhibiting step.

2. A method for controlling an image forming apparatus, the apparatus including means for forming an image on recording materials, means for feeding said recording materials to said image forming means; means for detecting presence and absence of said recording materials in a designated position of said feeing means; and means for detecting a size of said recording materials; said method comprising the steps of:

detecting an exhaustion of recording materials during the execution of said image forming operation;

interrupting the image forming operation in response to the detection of the exhaustion;

detecting a replenishment of recording materials;

comparing the size of recording materials having been used before the interruption with the size of the replenished recording materials; and providing a warning when said sizes are different from each other.

3. A method for controlling an image forming apparatus, the apparatus including means for forming an image on recording materials; means for feeding the recording materials to said image forming means; means for detecting presence and absence of said recording materials in a designated position of said feeing means; and means for detecting a kind of said recording materials; said method comprising the steps of:

detecting an exhaustion of recording materials during the execution of said image forming operation;

interrupting the image forming operation in response to the detection of the exhaustion;

detecting a replenishment of recording materials;

comparing the kind of recording materials having been used before the interruption with the kind of the replenished recording materials; and executing the image forming operation following release of said interruption, said release of said interruption being in response to said compared recording materials being of a same kind.

4. An image forming device comprising;

(a) means for forming an image on recording materials, (b) means for feeding said recording materials to said image forming means, (c) first detection means for detecting presence and absence of said recording materials in a designated position of said feeding means, (i) second detection means for detecting a size of said recording materials, (j) means for storing the size of the recording material detected by said second detection means, (g) first control means for interrupting the operation of said image forming means when said first detection means detects an exhaustion of recording materials during the execution of said image forming operation, (k) means for comparing the size of replenished recording material detected by said second detection means with the size of the recording material which is stored in said storing means when said first detection means detects the replenishment of the recording material, and (m) second control means for maintaining said interruption and issuing a size difference warning if difference of the sizes is detected by said comparison means.

5. An image forming device comprising:

(a) a means for forming an image on recording materials;

(b) a means for feeding said recording materials to said image forming means;

(c) a means for detecting presence and absence of said recording materials in a designated position of said feeding means;

(d) a means for inputting a command for starting the operation of said image forming means;

(e) a first control means for inhibiting said image forming means from starting the image forming operation if absence of recording materials is detected by said detection means when the operation start command is input by said input means, and (f) a second control means for starting the operation of said image forming means following release of said inhibition in response to a detection of presence of said recording materials in the designated position by said detection means.

6. An image forming device as claimed in claim 5, wherein said second control means starts said image forming operation following release of said inhibition after a predetermined time from the detection of said recording materials by said detection means.

7. An image forming device as claimed in claim 6, wherein said feeding means is provided with a paper feeding cassette which accommodates the recording materials and which is mountable to and dismountable from the image forming device.

8. An image forming device comprising:

(a) a means for forming an image on recording materials;

(b) a means for feeding said recording materials to said image forming means;

(c) a first detection means for detecting presence and absence of said recording materials in a designated position of said feeding means;

(d) a second detection means for detecting a size of said recording materials;

(e) a means for storing the size of the recording material detected by said second detection means;

(f) a first control means for interrupting the operation of said image forming means when said first detection means detects an exhaustion of recording materials during the execution of said image forming operation;

(g) a comparison means for comparing the size of replenished recording materials detected by said second detection means with the size of the recording material which is stored in said storing means when said first detection means detects the replenishment of the recording material, and (h) a second control means for executing said image forming operation following release of said interruption if the replenished recording material is detected by said comparison means to be of a size feasible for recording in place of the recording material before the interruption.

9. An image forming device as claimed in claim 8, wherein said second control means executes said image formation followed by releasing of said interruption after a predetermined time from detecting the replenished recording materials.

10. An image forming device as claimed in claim 8, wherein said feeding means is provided with a paper feeding cassette which accommodates the recording materials and which is freely mountable to and dismountable from the image forming device.

11. An image forming device as claimed in claim 10, wherein said second detection means comprises a plurality of marks arranged according to the kind of recording material defined in the paper feeding cassette, sensor means mounted on an image forming device side to detect said marks, and judgement means to decide the kind of the recording materials based on a signal from the sensor means.

12. An image forming device as claimed in claim 11, wherein said marks comprise projections, and said sensor means comprise microswitches.

13. An image forming device as claimed in claim 12, wherein said second detection means detects the mounting of the cassette to the image forming device.

14. An image forming device comprising:

(a) a means for forming an image on recording materials;

(b) a means for feeding said recording materials to said image forming means;

(c) a first detection means for detecting presence and absence of said recording materials in a designated position of said feeding means;

(d) a second detection means for detecting a kind of said recording materials;

(e) a means for storing the kind of the recording material detected by said second detection means;

(f) a first control means for interrupting the operation of said image forming means when said first detection means detects an exhaustion of recording materials during the execution of said image forming operation;

(g) a means for comparing the kind of replenished recording material detected by said second detection means with the kind of the recording material which is stored in said storing means when said first detection means detects the replenishment of the recording material, and (h) a second control means for executing the image forming operation following release of said interruption if sameness of the kinds is detected by said comparison means.

15. An image forming device as claimed in claim 14, wherein said second detection means detects a size of the recording material.

16. An image forming device as claimed in claim 14, wherein said second detection means detects a thickness of the recording material.

17. An image forming device as claimed in claim 14, wherein said second detection means detects a color of the recording material.

18. An image forming device as claimed in claim 14, wherein said second control means executes the image forming operation following release of said interruption after a predetermined time from detecting the sameness of the kinds.

19. An image forming device as claimed in claim 14, wherein said feeding means is provided with a paper feeding cassette which accommodates the recording materials and which is freely mountable to and dismountable from the image forming device.

20. An image forming device as claimed in claim 19, wherein said second detection means comprises a plurality of marks arranged according to the kind of recording material defined in the paper feeding cassette, sensor means mounted on an image forming device side to detect said marks, and judgement means to decide the kind of the recording materials based on a signal from the sensor means.

21. An image forming device as claimed in claim 20, wherein said marks comprise projections, and said sensor means comprise microswitches.

22. An image forming device as claimed in claim 21, wherein said second detection means detects the mounting of the cassette to the image forming device.

* * * * *